United States Patent [19]

Sullivan et al.

[11] Patent Number: 4,815,967

[45] Date of Patent: Mar. 28, 1989

[54] TAPER CANDLE BAR

[75] Inventors: Marian D. Sullivan; Elaine A. Tschetter, both of Sioux Falls, S. Dak.

[73] Assignee: Sullivan, Inc., Sioux Falls, S. Dak.

[21] Appl. No.: 102,037

[22] Filed: Sep. 29, 1987

[51] Int. Cl.[4] ..... F23D 3/16

[52] U.S. Cl. ..... 431/295; 431/296; 431/297

[58] Field of Search ..... 431/297, 296, 295; D26/23, 9, 10, 12, 13

[56] References Cited

U.S. PATENT DOCUMENTS

| | | | |
|---|---|---|---|
| 338,099 | 3/1886 | O'Boylan | 431/297 |
| 1,355,696 | 10/1920 | Ross | 431/297 |
| 2,658,297 | 11/1953 | Woolsey | 431/296 X |
| 2,747,393 | 5/1956 | Thorn | 431/297 X |
| 2,809,512 | 10/1957 | Hartnett | 431/297 X |
| 3,303,611 | 2/1967 | Erbguth | 431/295 X |

FOREIGN PATENT DOCUMENTS

| | | | |
|---|---|---|---|
| 973381 | 8/1975 | Canada | 431/297 |
| 300325 | 1/1917 | Fed. Rep. of Germany | 431/295 |
| 2345663 | 10/1977 | France | 431/295 |
| 20282 | of 1896 | United Kingdom | 431/297 |
| 123634 | 3/1919 | United Kingdom | 431/297 |
| 188909 | 11/1922 | United Kingdom | 431/297 |

*Primary Examiner*—Randall L. Green

*Attorney, Agent, or Firm*—Merchant, Gould, Smith, Edell, Welter & Schmidt

[57] ABSTRACT

An adapter (18) for supporting one of more taper candles instead of a single pillar candle, on a candle ring (16) in a centerpiece arrangement includes an elongated plate (30), one or more candle holders (32), and end clips (36) for snap-releaseable engagement with the inner ring of the candle ring. A second embodiment (50) is adapted for supporting a single taper candle with a smaller candle ring.

11 Claims, 3 Drawing Sheets

TAPER CANDLE BAR

TECHNICAL FIELD

The present invention relates generally to a mount, and more particularly to a mounting device or adapter for use with a candle ring in a centerpiece arrangement so that either taper or pillar candles of different sizes can be used for more versatility, variety and economy.

BACKGROUND ART

Artificial centerpiece arrangements are typically used on tables and the like for decorative purposes. Such centerpiece arrangements often include a candle and surrounding candle ring on which artificial flowers, leaves and the like are attached. The candle rings have been available for years and generally consist of one plastic ring member, or several tiered ring members of different diameters, each having mounting pegs thereon to which the artificial flowers, leaves and the like are attached.

In order to change the appearance of such centerpiece arrangement to fit the occasion, the candle or flowers can be changed. Changing the artificial flowers on the candle ring can be both expensive and time consuming. Heretofore, candle rings traditionally have been adapted for use with column or pillar candles, which are relatively bulky and expensive and tend to be less readily available and/or only available in limited colors and styles. Because these candle rings have been previously limited to a single size candle, the kinds of centerpiece arrangements possible have not been as varied or versatile as they might have been.

Some centerpiece arrangements would be much more attractive with the relatively taller, less expensive and more readily available taper candles, but there has not been available heretofore an adapter by which such candles could be used with candle rings in a way that enables the user to utilize either pillar or taper candles as desired with a particular candle ring for maximum variety and versatility.

A need has thus arisen for a taper candle bar which can be inserted into an existing candle ring enabling the use of taper candles and when removed reverting the candle ring back for use with to the original pillar candle while still maintaining the original centerpiece style design.

SUMMARY OF INVENTION

The present invention comprises an adapter bar that overcomes the foregoing and other difficulties associated with the prior art. In accordance with the invention, there is provided a taper candle bar which is adapted for use with a candle ring so that either a pillar candle or one or more taper candles can be utilized as desired without changing candle rings.

The taper candle bar of the first embodiment comprises an elongate base plate of sufficient length to span the inside top diameter of the candle ring. One or two taper holders are mounted in spaced-apart, symmetrical relationship on the plate. Each taper holder preferably includes wedges or gussets therein for securing the candle in place. Clips are provided at opposite ends of the plate for releasable engagement with the candle ring. Each clip is preferably notched to receive a radial piece in the candle ring to achieve a "buckle" effect for balance and stability.

A second embodiment, which is adapted for use with smaller candle rings, includes a single candle holder and a circular base plate that receives the candle ring thereover and rests on the underlying surface for stability. Clips are provided about the candle holder for releasable engagement with the candle ring and to secure the candle ring itself.

BRIEF DESCRIPTION OF DRAWINGS

A better understanding of the invention can be had by reference to the following Detailed Description in conjunction with the accompanying Drawings, wherein.

DETAILED DESCRIPTION

Figure 1:
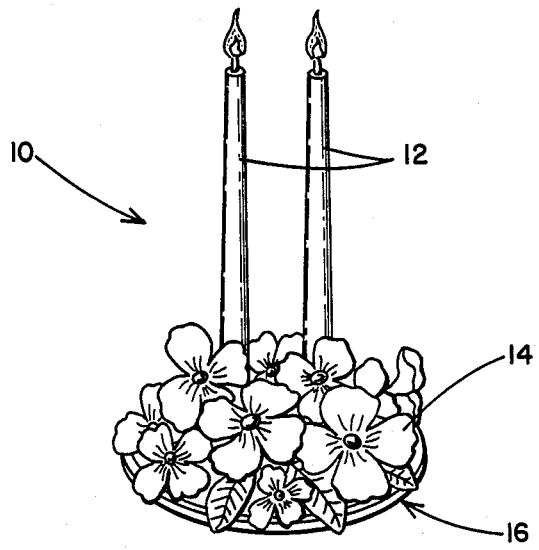
FIG. 1 is a perspective view of a centerpiece arrangement including the taper candle bar of the invention.
Figure 2:
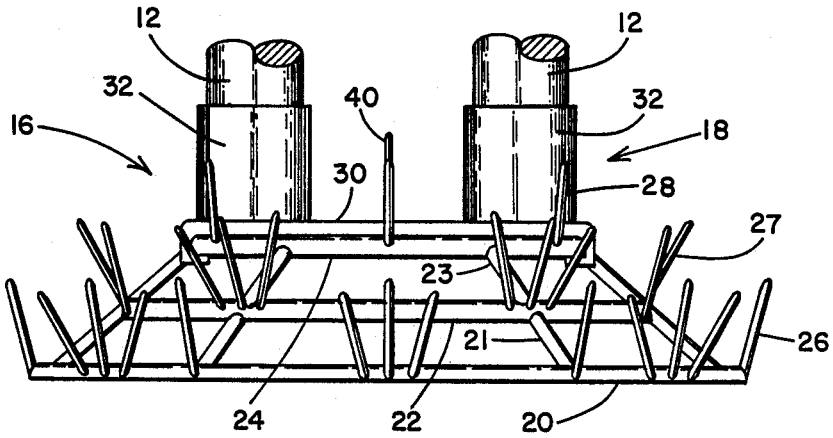
FIG. 2 is a side view of a candle ring with the taper candle bar of the first embodiment.

Referring now to the Drawings, wherein like reference numerals designate like or corresponding parts throughout the views, and particularly referring to FIGS. 1-5, there is shown a centerpiece arrangement 10 incorporating the taper candle bar of the invention. The centerpiece arrangment 10 includes a pair of taper candles 12 and artificial flowers 14. The flowers 14 are mounted on a candle ring 16, and the candles 12 are supported by the taper candle bar 18 of the first embodiment of the invention which is attached to the top of the candle ring, as will be explained more fully hereinafter.

The candle ring 16 is of substantially conventional, tiered construction. The candle ring 16, which is typically of molded plastic, includes three generally concentric ring members 20, 22 and 24 interconnected by generally radial spokes. Ring members 20 and 22 are interconnected by circumferentially spaced apart spokes 21, and ring members 22 and 24 are similarly interconnected by spokes 23. Prongs 26, 27 and 28 are provided on ring members 20, 22 and 24 respectively, for attachment of the artifical flowers 14, leaves and the like thereto. The candle ring 16 is adapted for placement over a pillar candle (not shown) which extends upwardly through the upper most, inner ring member 24, which is typically about 3.0 inches in diameter.

Figure 5:
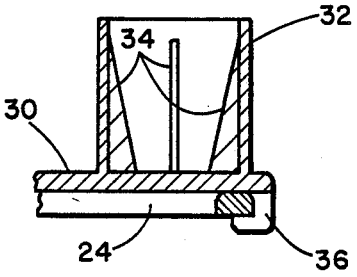
FIG. 5 is an enlarged partial section view taken along lines 5—5 of FIG. 3 in the direction of the arrows.
Figure 3:
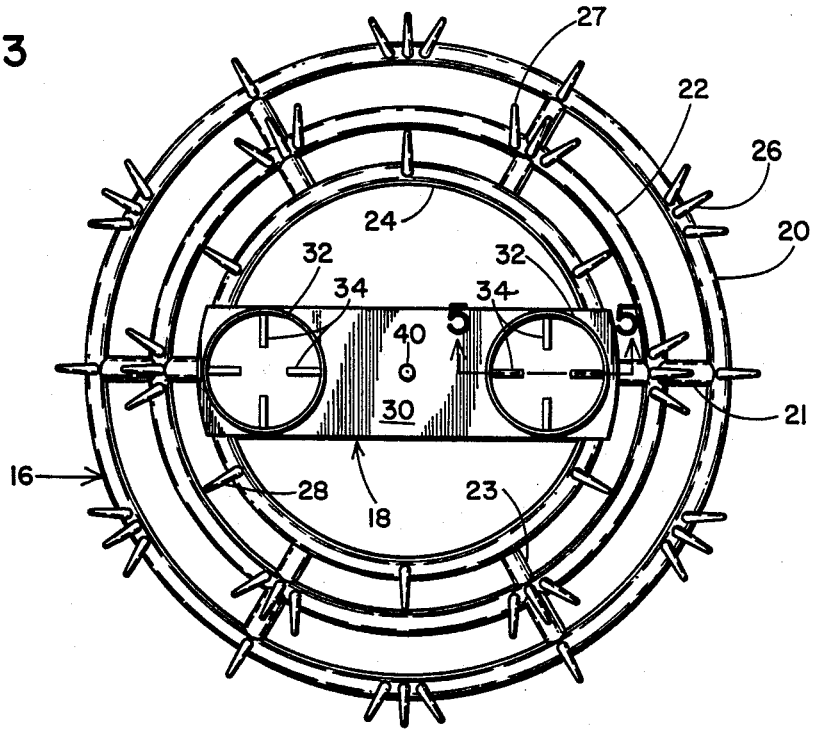
FIG. 3 is a top view thereof.
Figure 4:
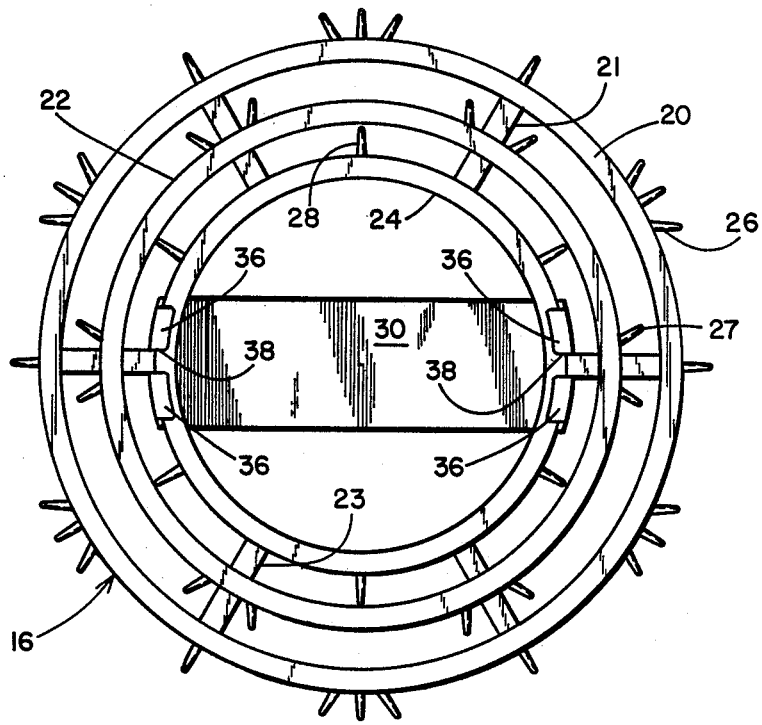
FIG. 4 is a partial bottom view thereof.

If one or two taper candles instead of a pillar candle are desired, the taper candle bar 18 can be used with candle ring 16. The candle taper bar 18 includes a plate 30 which is adapted to span the inner ring 24 of the candle ring 16. A pair of candle holders 32 are provided on plate 30 in spaced-apart, symmetrical relationship with respect to the midpoint of the plate for stability. EAch holder 32 preferably includes wedge-shaped gussets 34 therein as best seen in FIGS. 3 and 5, to help secure the taper candles 12 in place. The candle bar 18 is preferably constructed from molded plastic. Although the candle bar 18 includes two symmetrically positioned candle holders 32, a single central holder could be used instead.

Clips 36 are provided at opposite ends of the plate 30 of the taper candle bar 18 for engagement with the candle ring 16. In particular, the clips 36 are adapted to snap over the inner ring member 24. In the preferred embodiment, each clip 36 includes a central notch 38 therein for receiving spokes 23 in the candle ring 16 to provide a "buckle" effect for added stability. Since the spokes 23 in candle ring 16 are arranged in opposite, diametric pairs, this also helps assure proper centering and balance of the taper candle bar 18 on candle ring 16. For purposes of clarity, the candles 12 have been omitted from FIGS. 3 and 5.

If desired, a prong 40 can also be provided on plate 30 midway between holders 32 for attachment of an artificial flower 14 directly to the taper candle bar 18.

Figure 6:
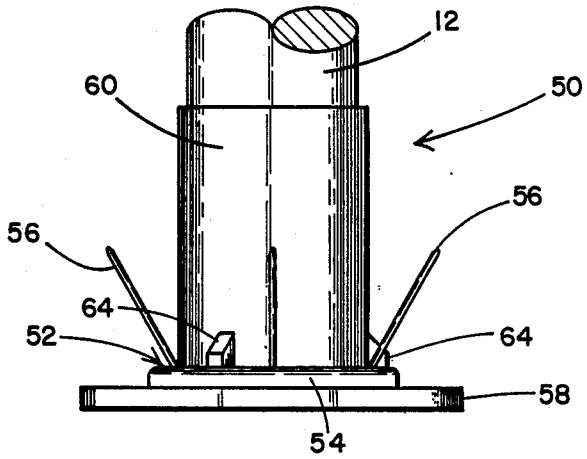
FIG. 6 is a side view of a taper candle bar of the second embodiment.
Figure 7:
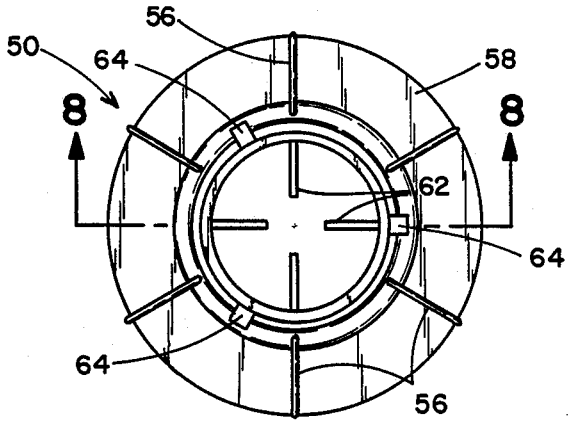
FIG. 7 is a top view thereof.
Figure 8:
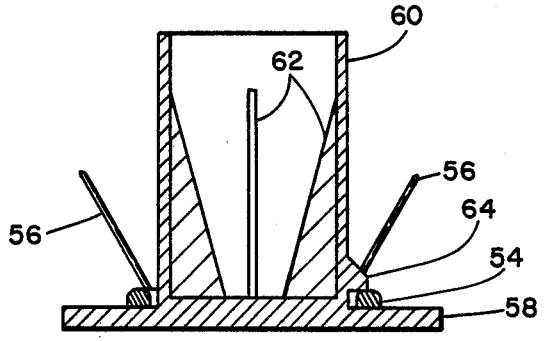
FIG. 8 is an enlarged partial section view taken along lines 8—8 of FIG. 7 in the direction of the arrows.

Referring now to FIGS. 6-8 there is shown a taper candle bar 50 incorporating a second embodiment of the invention. The taper candle bar 50 is particularly adapted for use with a relatively smaller candle ring 52, such as a 1.5 inch candle ring, comprising a single ring member 54 with prongs 56 thereon for receiving artificial flowers, leaves and the like in a centerpiece arrangement which has been omitted for clarity.

The taper candle bar 50 includes a base plate 58 which is circular, instead of elongate, and which is adapted to fit within the ring member 54 of the candle ring 52. In addition, the base plate 58 is of sufficient depth in order to extend through the candle ring 52 and rest directly on the underlying surface. The base plate 52 is preferably enlarged for additional stability. A generally cylindrical candle holder 60 is centrally secured to the base plate 58. Opposing pairs of wedge-shaped gussets 62 are provided therein for engagement with the base end of a single taper candle 12. For purposes of clarity, the candle 12 has been omitted from FIGS. 7 and 8.

The taper candle bar 50 also includes three clips 64 located at even circumferentially spaced-apart positions about the candle holder 60. The clips 64 are angled downwardly and outwardly to engage the ring 54 of the candle ring 52, which snaps down over the candle bar 50, between the clips and onto the base plate 58, in order to provide further stabilization for the taper candle bar 50. The outside diameter of the candle holder 60 is preferably slightly smaller than the inside diameter of ring member 54 to allow for deformation of the ring during connection or disconnection.

From the foregoing, it will thus be apparent that the present invention comprises a taper candle bar having numerous advantages over the prior art. One primary advantage is improved versatility so that either column or taper candles can be used with the same candle ring, and without changing the candle ring or the floral arrangement thereon, which in turn increases versatility of the overall centerpiece arrangement. Other advantages will be evident to those skilled in the art.

Although particular embodiments of the invention have been illustrated in the accompanying Drawings and described in the foregoing Detailed Description, it will be understood that the invention is not limited only to the embodiments disclosed, but is intended to embrace any alternatives, equivalents, modifications and/or rearrangement of elements falling within the scope of the invention as defined by the following claims.

What is claimed is:

1. A taper candle adapter for use with a candle ring, comprising:

a generally flat plate spanning the candle ring;

at least one generally cylindrical candle holder mounted in symmetrical position on said plate;

each candle holder including opposite pairs of internal gussets therein for engaging a taper candle at its lower end; and a pair of fixed, spaced-apart clips associated with said plate for snap-releasable engagement with the candle ring to secure the taper candle adapter thereto;

said plate, candle holder, internal gussets, and clips being constructed of integral molded plastic.

2. The taper candle adapter of claim 1, wherein said plate is substantially flat and rectangular, and extends over the candle ring.

3. The taper candle adapter of claim 1, wherein said plate is substantially flat and circular, and wherein a single candle holder is provided which extends upwardly through the candle ring in snug engagement therewith.

4. The taper candle adapter of claim 1, wherein a plurality of candle holders are mounted in spaced-apart symmetrical position on said plate.

5. A taper candle adapter for use with a candle ring, comprising:

a plate;

at least one generally cylindrical candle holder mounted in symmetrical position on said plate; and clips at opposite ends of said plate for engagement with the candle ring to secure the taper candle adapter thereon;

at least one prong on said plate for mounting artificial flowers and the like thereon.

6. A taper candle adapter for use with a candle ring, comprising:

a plate;

at least one generally cylindrical candle holder mounted in symmetrical position on said plate; and clips at opposite ends of said plate for engagement with the candle ring to secure the taper candle adapter thereon;

the clip at each end of said plate including a central notch therein for receipt by a radial portion of the candle ring.

7. A taper candle adapter for use with a candle ring, comprising:

a flat, elongate plate of sufficient length to span the candle ring;

at least one generally cylindrical candle holder mounted in symmetrical position between the ends of said plate; and underturned clips on opposite ends of said plate for snap-releaseable engagement with the candle ring to secure the candle taper bar thereon each clip including a notch for receipt by a radial portion of the candle ring.

8. The taper candle adapter of claim 7, wherein each candle holder includes opposite pairs of wedge-shaped gussets therein for engaging the candles at its lower end.

9. The taper candle adapter of claim 7, wherein said plate, candle holder, and clips are of integral molded plastic construction.

10. A taper candle adapter for use with a candle ring, comprising:

a flat, generally circular plate of sufficient diameter to receive the candle ring thereon;

a single generally cylindrical candle holder mounted in central position on said plate and extending through the candle ring; and a plurality of circumferentially spaced-apart clips about said candle holder, in spaced relationship with said plate, for engagement with the surrounding candle ring; said plate, candle holder, and clips being of integral molded plastic construction.

11. The taper candle adapter of claim 10, wherein said candle holder includes opposite pairs of wedge-shaped internal gussets therein for engaging the taper candle at its lower end

* * * * *